US006536126B2

(12) United States Patent
Wilson

(10) Patent No.: US 6,536,126 B2
(45) Date of Patent: Mar. 25, 2003

(54) WRITING AID

(76) Inventor: Camille Wilson, 3656 Dutch Valley Dr., Las Vegas, NV (US) 89147

( * ) Notice: Subject to any disclaimer, the term of this patent is extended or adjusted under 35 U.S.C. 154(b) by 0 days.

(21) Appl. No.: 09/921,719

(22) Filed: Aug. 3, 2001

(65) Prior Publication Data

US 2003/0024130 A1 Feb. 6, 2003

(51) Int. Cl.[7] ..... B43L 13/00
(52) U.S. Cl. ..... 33/477; 33/18.2; 434/166
(58) Field of Search ..... 33/18.1, 18.2, 33/19.2, 41.1, 41.2, 41.4, 41.6, 42, 44, 429, 474, 477; 434/166, 117; 401/6

(56) References Cited

U.S. PATENT DOCUMENTS 251,206 A * 12/1881 Forbush ..... 434/166
510,372 A * 12/1893 Wells ..... 434/166
2,143,426 A * 1/1939 Wride ..... 33/427
2,720,706 A * 10/1955 Laine ..... 33/427
4,089,126 A * 5/1978 Lang ..... 434/163
5,980,257 A * 11/1999 Heinz ..... 401/48

* cited by examiner

*Primary Examiner*—Christopher W. Fulton
*Assistant Examiner*—Amy R Cohen
(74) *Attorney, Agent, or Firm*—Quirk & Tratos

(57) ABSTRACT

A guide assembly useful in restraining the vertical writing excursions of those with impaired muscular control includes a generally orthogonal frame supporting one or more stretched elastic bands spaced adjacent the horizontal leg of the frame. The vertical leg is then used for alignment along the edge of the writing surface.

15 Claims, 3 Drawing Sheets

WRITING AID

BACKGROUND OF THE INVENTION

1. Field of the Invention

The present invention relates to writing templates and guides, and more particularly to resilient guides useful in constraining the writing strokes of those having imperfect control over their writing musculature.

2. Description of the Prior Art

Templates that guide the hand of those attempting to write are well known in the art. Most frequently such templates provide a correctly formed edge along which the writing instrument is drawn in order to produce a properly formed letter or number. Examples of such templates can be found in the teachings of U.S. Pat. No. 5,027,523 to MacLeod; U.S. Pat. No. 5,516,152 and U.S. Pat. No. 5,707,081 to Luna; U.S. Pat. No. 4,470,197 to Pagalies; and others. While suitable for the purposes intended, each of the foregoing is focused on defining the graphic form of the alphanumeric character and not at assisting in the muscular movements in the course of writing.

The course of training undeveloped writing musculature, and/or the course of assisting those suffering from muscular infirmity or disease like muscular dystrophy entails different notions than those entailed in the proper graphic form of a character. Typically those suffering from imperfect muscular control because of lack of sufficient development or disease lack the necessary muscular responses associated with the larger movements of a well behaved servo-mechanism and therefore need mechanical assistance in maintaining the writing instrument position relative the lines on a page. Once this is attained sufficient small movement control exists to produce a readable character. In such instances training and assistance are better achieved by devices that urge or prefer one or another direction of movement in order to position the writing hand, leaving the remainder of the writing movement essentially unconstrained. The preferred training and assistance mechanism is one that directs the larger muscular movements and it is one such mechanism that is disclosed herein.

SUMMARY OF THE INVENTION

Accordingly, it is the general purpose and object of the present invention to provide a writing guide that aligns an elastic member along the writing line to resiliently guide the writer's musculature.

Other objects of the invention are to provide a writing guide that defines a resilient boundary along the preferred positions of the handwritten text.

Yet further objects of the invention are to provide a resilient line guide useful in assisting those with imperfect or undeveloped writing musculature.

Briefly, these and other objects are accomplished within the present invention by providing a rectilinear frame defined by a vertical piece joined to a horizontal piece, where the edge of the vertical piece is also useful to guide the frame along the paper. The free end of the horizontal piece, moreover, is provided with an offset attachment to which one end of an elastic band is secured with the other end stretched to engage the edge of the vertical piece in a generally spaced relationship adjacent the horizontal piece. In this form the elastic band or strip is stretched over the paper, providing a restraint or guide to the vertical excursions of any writing instrument and thereby assisting those with less than precise control over small movement of their musculature.

In an alternative implementation several elastic strips can be thus stretched in parallel, between several points of engagement, to provide such elastic restraint on both extremes of vertical excursion as may be desired. Moreover, the frame pieces may be releasably secured to each other for convenient collapse and storage. Thus a widely adaptable structure is devised which is simple in assembly, convenient in use and inexpensively produced.

DESCRIPTION OF THE PREFERRED EMBODIMENTS

Figure 1:
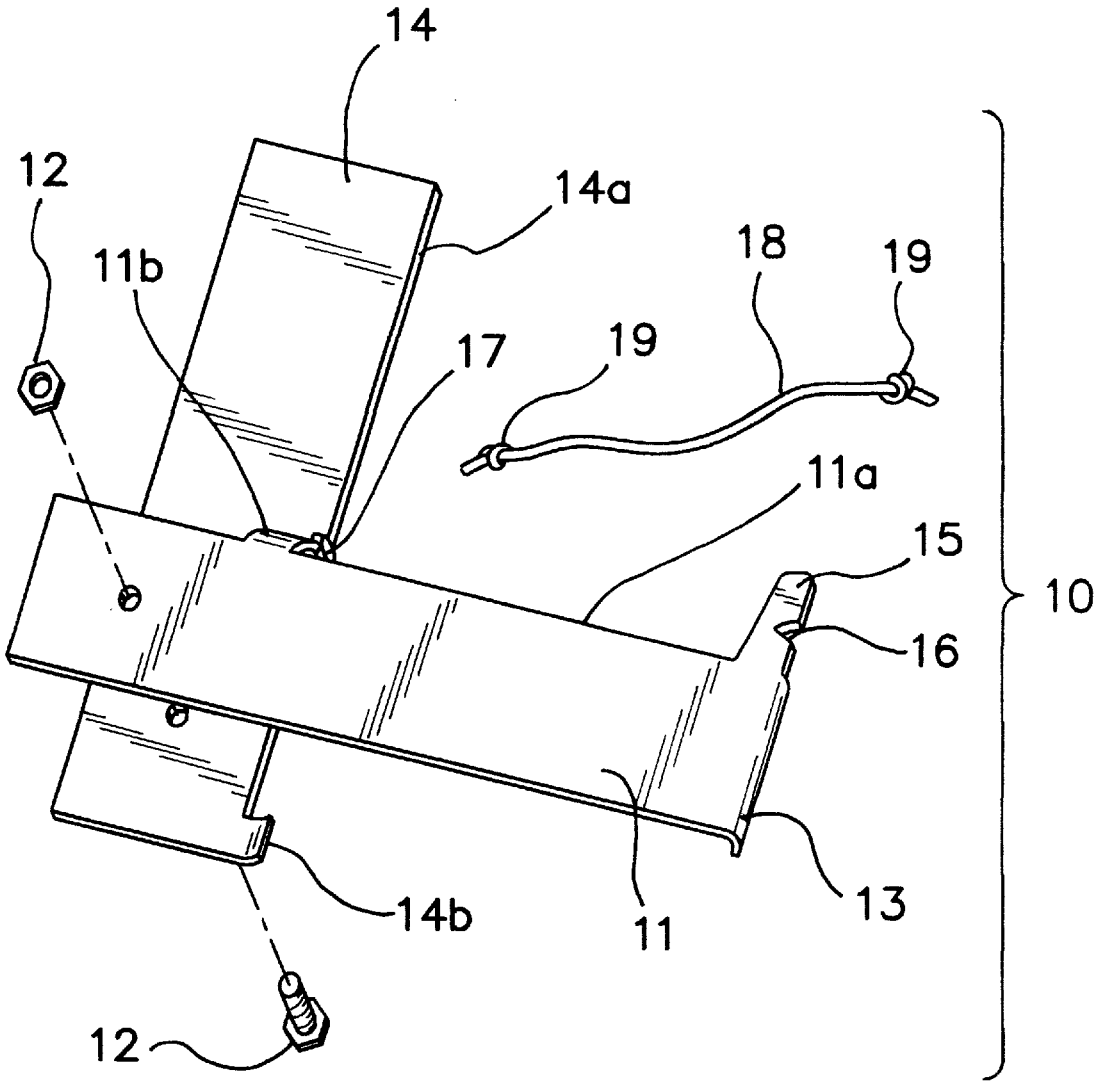
FIG. 1 is a perspective illustration, separated by parts, of one implementation of the inventive writing aid.
Figure 2:
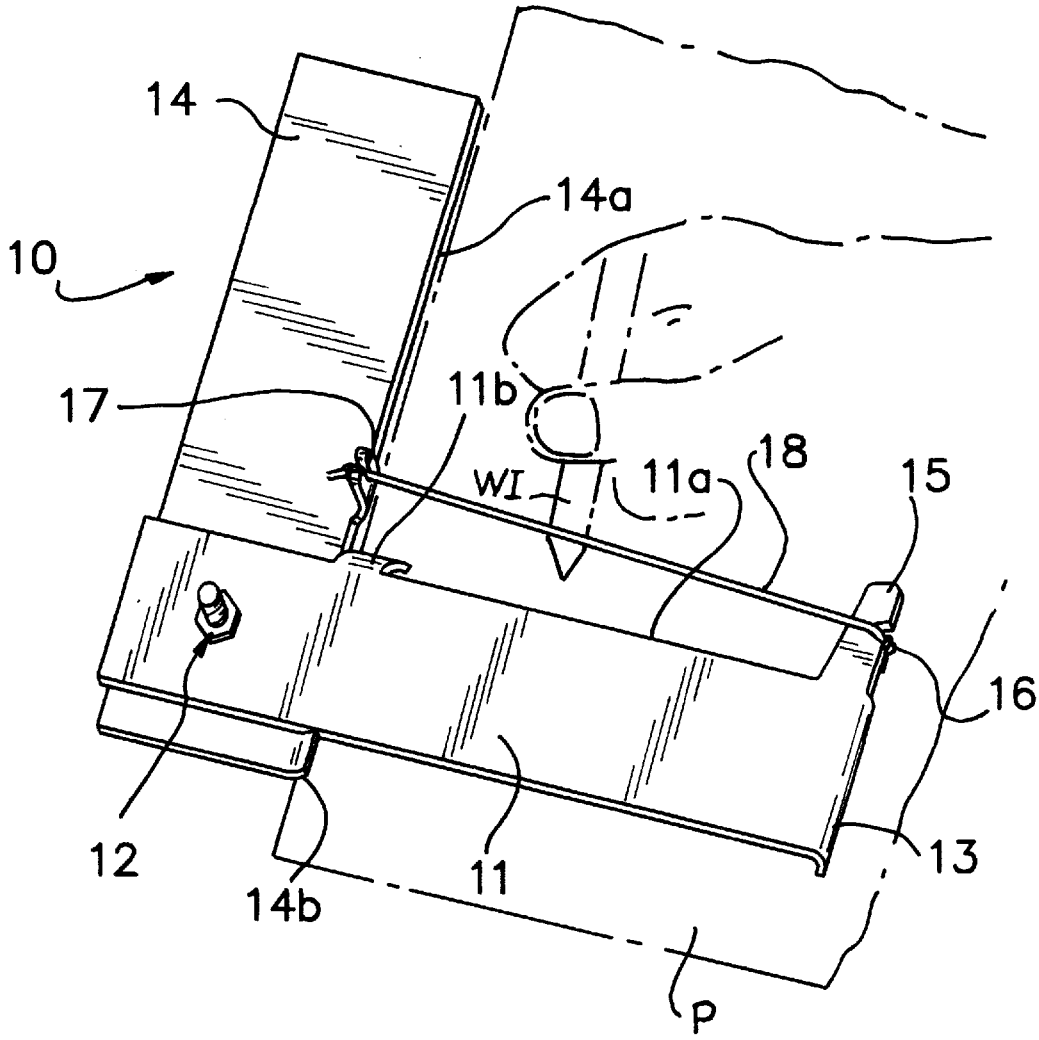
FIG. 2 is yet another perspective illustration of the first implementation in its assembled form and aligned for use.
Figure 3:
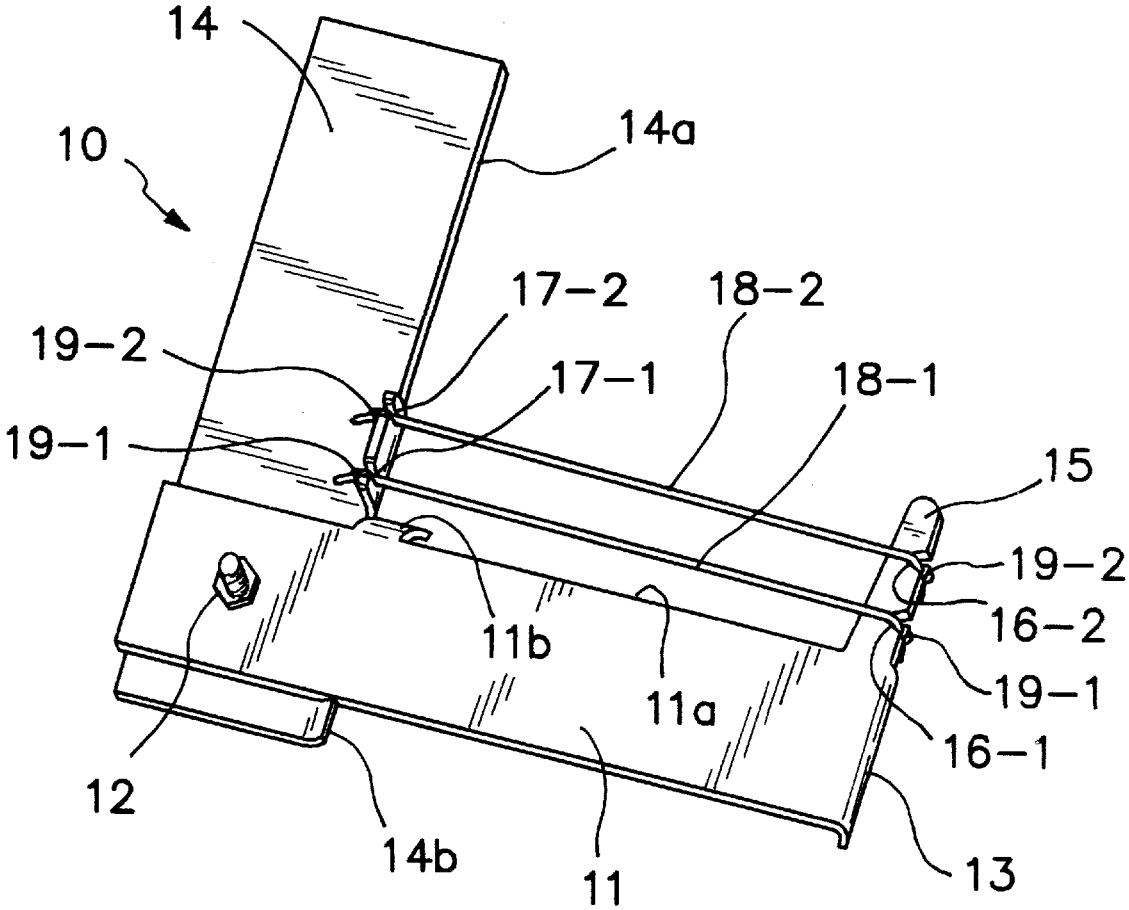
FIG. 3 is a plan view of a further implementation of the inventive writing aid, conformed for various modes of use.

As shown in FIGS. 1–3, the inventive writing aid, in its first implementation generally designated by the numeral 10, includes a horizontal piece 11 securable by a fastener assembly 12 to a vertical piece 14. Preferably each of the pieces 11 and 14 are formed as generally flat planar surfaces including at least one straight edge respectively shown as edges 11*a* and 14*a*. Moreover, the respective pieces 11 and 14 may be provided with detents 11*b* and 14*b* proximate the overlapping segments thereof by which a defined angular alignment is insured once the pieces are connected to each other by the fastener 12. In this manner the edge 14*a* is useful as a guide along one edge of a writing page P.

The free end of piece 11, furthermore, may be provided with a vertical extension 15 perforated or notched at its end for providing an attachment 16 engaging one end of an elastic strip 18 and with an offset spacer 13 lifting the surface of the piece and the band 18 tied thereto off the writing surface. The other end of the band or strip 18 may then be stretched to a slot 17 along the edge 14*a*. Thus the band 18 is stretched in a spaced alignment relative edge 11*a*, providing a resilient barrier to any vertical excursion of a writing instrument WI, thereby assisting those with less than perfect muscular control. This resilient barrier may be variously tensioned by the expedience of the stretching tension of the band 18, achieved conveniently by a knot or loop 19 selectively effected along the stretched length of the band.

In a further alternative, shown in FIG. 3, vertical excursion restraint may be effected at both the upper and lower ranges of vertical motion by providing two elastic bands stretched in parallel alignment. Like numbered parts functioning in a like manner to that previously described, in this configuration the horizontal piece 11 is provided with an enlarged extension 15-1 projecting orthogonally from edge 11*a* in the plane of piece 11 including two spaced slots 16-1 and 16-2 formed therein. Openings 16-1 and 16-2 are spaced from each other by the vertical increment of normal writing and are therefore useful to engage the ends of two elastic bands 18-1 and 18-2 which are then stretched to a set of equally spaced tie down slot openings 17-1 and 17-2 formed in the vertical piece 14 adjacent its edge 14*a*. Again, by selecting the location of knots 19-1 and 19-2 tied in bands 18-1 and 18-2 a desired tension level can be achieved in each of the bands to provide such resilient restoring force as may be needed in effecting control over unwanted excursions of the writing instrument WI.

In this manner an inexpensive, easily assembled guide is obtained that is useful in restraining imperfect muscular control by selectively stretched elastic bands that are lifted off the writing surface at both ends.

Obviously many modifications and variations can be effected without departing from the spirit of the invention instantly disclosed. It is therefore intended that the scope of the invention be determined solely by the scope of the claims appended hereto.

It is claimed:

1. Apparatus for restraining the writing strokes of a person, comprising:

a generally planar frame defined by a horizontal member joined at one end thereof to a corresponding end of a vertical member, the other end of said horizontal member including a planar projection extending in spaced relationship along said vertical member; and an elastic band secured at one end to said projection and stretched to engage said vertical member in a generally parallel spaced alignment relative said horizontal member.

2. Apparatus according to claim 1, wherein: said horizontal and vertical members each include at least one straight longitudinal edge.

3. Apparatus according to claim 2, wherein: said one longitudinal edge of said horizontal member is aligned generally orthogonally relative the corresponding one longitudinal edge of said vertical member.

4. Apparatus according to claim 2, wherein:

said one longitudinal edge of said horizontal member is aligned generally orthogonally relative the corresponding one longitudinal edge of said vertical member.

5. Apparatus according to claim 4, wherein:

each said elastic band are secured in stretch to a preselected level of tension.

6. Apparatus according to claim 1, wherein:

said horizontal and vertical members each include at least one straight longitudinal edge.

7. Apparatus for restraining the writing strokes of a person, comprising:

a generally planar frame defined by a horizontal member joined at one end thereof to a corresponding end of a vertical member, the other end of said horizontal member including a planar projection extending in spaced relationship along said vertical member; and a plurality of elastic bands each secured in spaced separation relative the others at a corresponding one ends thereof to said projection and stretched to engage in equally spaced separation said vertical member in a generally parallel alignment relative said horizontal member.

8. An assembly useful to cooperatively form a guide for restraining the writing strokes of a person, comprising:

a generally planar vertical piece including a longitudinal edge;

a generally planar horizontal piece including a longitudinal edge and conformed for selective overlying attachment at one end thereof to one end of said vertical piece and including a planar projection and an offset at the other end thereof; and an elastic band secured at one end to said projection and stretched to engage said vertical piece in a generally parallel spaced alignment relative said horizontal piece.

9. Apparatus according to claim 8, wherein:

said one longitudinal edge of said horizontal member is aligned generally orthogonally relative the corresponding one longitudinal edge of said vertical member.

10. Apparatus according to claim 9, wherein:

said elastic band is secured in stretch to a preselected level of tension.

11. Apparatus according to claim 10, wherein:

said offset is generally of the thickness of said vertical piece.

12. An assembly useful to cooperatively form a guide for restraining the writing strokes of a person, comprising:

a generally planar vertical piece including a longitudinal edge;

a generally planar horizontal piece including a longitudinal edge and conformed for selective overlying attachment at one end thereof to one end of said vertical piece and including a planar projection and an offset at the other end thereof; and a plurality of elastic bands each secured in spaced separation relative the others at a corresponding one ends thereof to said projection and stretched to engage in equally spaced separation said vertical piece in a generally parallel alignment relative said horizontal piece.

13. Apparatus according to claim 12, wherein:

said one longitudinal edge of said horizontal member is aligned generally orthogonally relative the corresponding one longitudinal edge of said vertical member.

14. Apparatus according to claim 13, wherein:

each said elastic band are secured in stretch to a preselected level of tension.

15. Apparatus according to claim 14, wherein:

said offset is generally of the thickness of said vertical piece.

* * * * *